United States Patent [19]

Penninger

[11] Patent Number: 4,734,257

[45] Date of Patent: Mar. 29, 1988

[54] METHOD OF INHIBITING CORROSION OF NONFERROUS METALS IN AQUEOUS SYSTEMS USING 3-AMINO-5-(ω-HYDROXYALKYL)-1,2,4-TRIAZOLES

[75] Inventor: Josef Penninger, Hilden, Fed. Rep. of Germany

[73] Assignee: Henkel Kommanditgesellschaft auf Aktien, Duesseldorf, Fed. Rep. of Germany

[21] Appl. No.: 865,225

[22] Filed: May 20, 1986

[30] Foreign Application Priority Data

May 31, 1985 [DE] Fed. Rep. of Germany ..... 3519522

[51] Int. Cl.[4] ..... C23F 11/06; C23F 11/14

[52] U.S. Cl. ..... 422/13; 548/266; 422/16; 252/392

[58] Field of Search ..... 548/266; 422/13, 16; 252/391, 392, 389.21, 390

[56] References Cited

U.S. PATENT DOCUMENTS 3,382,087 5/1968 Ostrowski ..... 252/390 X
3,553,101 1/1971 Foroulis ..... 252/390 X
4,098,720 7/1978 Hwa ..... 252/390 X
4,298,568 11/1981 Gerhardt et al. ..... 422/16

OTHER PUBLICATIONS

Chem. Abstract 99:139891, vol. 99 (1983), p. 594.
Chem. Abstract 95:150693, vol. 95 (1981), p. 675.
Chem. Abstract 69:27342, vol. 69 (1968), p. 2548.

*Primary Examiner*—Matthew A. Thexton
*Attorney, Agent, or Firm*—Henry E. Millson, Jr.; Mark A. Greenfield; Real J. Grandmaison

[57] ABSTRACT

The present invention provides a method of inhibiting the corrosion of nonferrous metals using an anticorrosive agent selected from 3-amino-5-(ω-hydroxy-n-alkyl)-1,2,4-triazoles having the general formula:

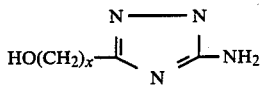

(I)

wherein x is an integer in the range of from 1 to 12; salts of the compounds of formula (I) with inorganic acids; and salts of the compounds of formula (I) with organic acids.

16 Claims, No Drawings

METHOD OF INHIBITING CORROSION OF NONFERROUS METALS IN AQUEOUS SYSTEMS USING 3-AMINO-5-(ω-HYDROXYALKYL)-1,2,4-TRIAZOLES

BACKGROUND OF THE INVENTION

1. Field of the Invention

The subject matter of the present invention relates to the use of corrosion inhibitors for nonferrous metals exposed to aqueous systems. More particularly, the present invention relates to a method of prohibiting corrosion of nonferrous metals using 3-amino-5-hydroxyalkyl-1,2,4-triazoles.

2. Description of Related Art

Because of their corrosion resistance, nonferrous metals such as copper and zinc, and alloys of nonferrous metals such as brass and bronze are preferred materials in the construction of water-conveying apparatus such as those used in steam generating plants, heating systems, cooling water circulating systems and the like. These materials are of particular importance for condenser tubes in steam power plants.

Despite relatively good corrosion resistance, analytically determinable amounts of high-grade materials, particularly copper, unavoidably are transferred to the surrounding water in normal use. The copper then deposits downstream on cooling water pipes made of steel or other base materials causing pitting corrosion sometimes with disastrous results.

For this reason, water contacting nonferrous metals must be treated in order to avoid the consequences of this metal, e.g., copper, transfer. In practice, very few inhibitors are suitable for this purpose. Suitable inhibitors include mercaptobenzthiazole, benzotriazole, tolyl triazole and benzimidazole. While these compounds are relatively effective copper corrosion inhibitors, they have the great disadvantage of being difficult, and hence expensive, to produce. Therefore, they have found only limited application.

Another disadvantage of the above-mentioned compounds is their poor solubility in acidic aqueous solutions, so that preparation and packaging of commercial aqueous anticorrosion preparations and especially concentrated anticorrosion preparations involves great difficulties. Moreover, concentrates of these materials tend to be unstable over extended periods of time, and these compounds and their derivatives have a high toxicity. Thus, these materials cannot be used in certain fields of application.

U.S. Pat. No. 4,298,568 discloses the use of 3-amino-5-alkyl-1,2,4-triazoles for inhibiting the corrosion of nonferrous metals in industrial water systems. Although these compounds are easier to produce and have better properties with respect to their technical applications, there still is a need in the art for an improved corrosion inhibitor for nonferrous metals in contact with aqueous systems.

It is an important object of the present invention to provide methods of chemically inhibiting corrosion of nonferrous metals with corrosion inhibitors having not only good applicational properties, but also providing a high degree of corrosion protection, even at low corrosion inhibitor concentrations. It is another important object of the present invention to provide a method of inhibiting corrosion utilizing corrosion inhibitors which can be stored as concentrates over extended periods of time without loss of activity.

DESCRIPTION OF THE INVENTION

It has now surprisingly been found that 3-amino-5-hydroxyalkyl-1,2,4-triazoles and their salts, provide a high degree of corrosion protection for nonferrous metals in aqueous systems and have excellent technical application properties as well.

The present invention comprises a method of inhibiting the corrosion of nonferrous metals in contact with water by adding to the water a 3-amino-5-(ω-hydroxy-n-alkyl)-1,2,4-triazole having the following general formula:

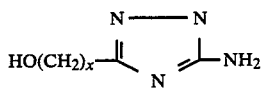

(I)

wherein x is an integer in the range of from 1 to 12; and/or a salt of the compound of formula (I) with an inorganic or organic acid .

Compounds corresponding to formula (I) are known. The present invention comprises a method of using these compounds to inhibit the corrosion of nonferrous metals exposed to an aqueous environment. In accordance with the present invention, the alkyl residue at the 5-position of the triazole ring of the formula (I) compound is linear, contains from 1 to 12 carbon atoms and has a terminal hydroxy group. Compounds of formula (I) wherein the alkyl residue at the 5-position of the triazole ring contains from 7 to 12 carbon atoms are preferred. Thus, the preferred alkyl residues are 7-hydroxyheptyl, 8-hydroxyoctyl, 9-hydroxynonyl, 10-hydroxydecyl, 11-hydroxyundecyl and 12-hydroxydodecyl.

The 3-amino-5-(ω-hydroxyalkyl)-1,2,4-triazoles may be prepared according to well-known methods. For example, the triazole derivatives can be prepared by reacting an α,ω-hydroxycarboxylic acid with either aminoguanidine or aminoguanidine hydrogen carbonate in an aqueous system. When α,ω-hydroxycarboxylic acids having from 4 to 6 carbon atoms are employed, the corresponding lactones may also be used in the reaction. Reactions are exemplified by the following reaction schemes:

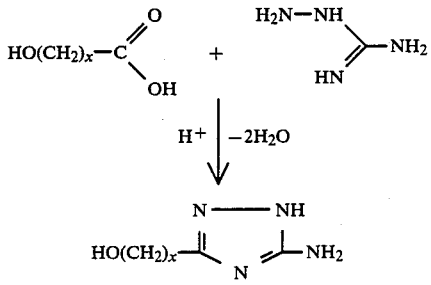

(I)

-continued

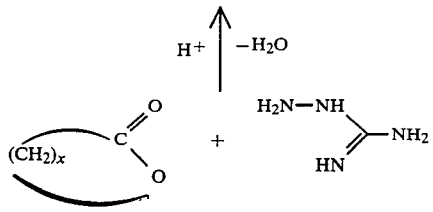

Salts of the compounds of formula (I) also may be employed as anticorrosive agents according to the method of the present invention. Salts of inorganic acids as well as salts of organic acids can be used. Preferred salts of inorganic acids include the chlorides, sulfates and phosphates of the formula (I) compounds. Preferred salts of organic acids include acetates, citrates and glycolates (glycolic acid salts) of the 1,2,4-triazole derivatives of formula (I).

In accordance with the method of the present invention, the above-identified anticorrosive compounds can be employed either alone or in mixtures. In use, a corrosion inhibiting amount of the formula (I) compounds, or their salts, may be dissolved directly in the aqueous system in accordance with known methods. Alternatively, the compounds may be added to the aqueous system in the form of an aqueous concentrate. Generally, the concentrate will contain the corrosion inhibiting compound in an amount of at least 5% and up to about 30%. The corrosion inhibiting compounds are added to the aqueous systems normally to obtain a concentration of at least about 0.05 g/m$^3$, generally within the range of from about 0.05 to about 10 g/m$^3$, and preferably within the range of from about 0.1 to about 5 g/m$^3$.

According to the invention, the anticorrosive formula (I) compounds and/or their salts formed by reaction with inorganic or organic acids, can be used in aqueous systems, including industrial water, cooling water, lubricants and cleaners for household and industrial purposes. The pH of these aqueous systems are generally in the range of from about 6 to 10.

In practice, the presence or formation of deposit-forming or turbidity-causing substances, like hardness precipitations, clay substances and iron hydroxides may also play an important role in the corrosion behavior of an aqueous system or of industrial water. By preventing these deposits, the corrosive behavior of a water may be improved further. It may, therefore, be advantageous to add to the water to be treated additional known concretion preventing agents and dispersing agents. Suitable additives include polyacrylic acid or acrylic acidmethacrylic acid copolymers with an average molecular weight of between 500 and 4,000, in the form of their alkali metal salts or ethylene oxide-propylene oxide block copolymers with an average molecular weight of between 500 and 3,000, and an ethylene oxide-propylene oxide ratio of 10:90 to 30:70.

The above-mentioned concretion preventing agents and dispersing agents may be used in amounts of 1 to 50 g/m$^3$, preferably 3 to 10 g/m$^3$.

If ecological aspects are of no concern, particularly in cooling systems, water-soluble zinc salts and/or phosphorus-containing compounds also may be added.

Particularly zinc chloride and zinc sulfate may be used as zinc salts. Amounts of 0.5 to 10 g/m$^3$, preferably 1 to 4 g/m$^3$ (calculated as zinc) may be used, corresponding to an amount of 0.5 to 10 ppm, preferably 1 to 4 ppm.

In particular, complexing phosphonic acids may be used as phosphorus-containing compounds, such as 1-hydroxyethane-1,1-diphosphonic acid, aminotrimethylenephosphonic acid, and 2-phosphonobutane-1,2,4-tricarboxylic acid, as well as their water-soluble salts or mixtures of these compounds. These compounds are employed in the same amounts as the zinc salts. Such a combination may considerably increase the corrosion protection.

Although certain embodiments of the invention have been selected for description in the examples hereinafter, it will be appreciated by those skilled in the art that these examples are merely illustrative of, but do not in any way limit, the scope of the present invention which is defined in the appended claims.

The anticorrosive properties were determined by mass reduction analyses in accordance with DIN 50905/1-4 (German Industrial Norm).

EXAMPLE 1

Three electrolytic copper strips having dimensions of 80 mm×15 mm×1 mm were carefully pre-treated, weighed and immersed in a 1 liter vessel containing a mixture of 800 ml of an aqueous corrosive test solution, 50 ml of a buffer solution and a defined amount of a compound of formula (I). A control experiment was also conducted utilizing a solution containing no corrosion inhibitor. The immersions were performed at room temperature for 24 hours while the solution was stirred by a mechanical stirrer rotating at a speed of 80 rpm.

The aqueous corrosive test solution was prepared in accordance with DIN 51360/2 and was buffered to a pH of 9.0 with ammonia/ammonium chloride.

After expiration of the 24 hour test period, the copper strips were dried and reweighed. From the measured weight loss, an anticorrosion value S, was calculated in accordance with the following equation:

$$S=100\,(1-A/B)$$

wherein A represents the weight loss of the test specimen and B represents the weight loss of the control specimen. Thus, an S value of 100 corresponds to complete resistance to corrosion, i.e., no weight loss in the test strip.

The results of the mass reduction tests, at corrosion inhibitor concentrations of 2 g/m$^3$, 5 g/m$^3$ and 10 g/m$^3$ and for corrosion inhibitors having hydroxyalkyl residues containing 1, 3, 5, 8 and 11 carbon atoms, are presented in the following Table 1. For comparison purposes, the S value of two 3-amino-5-alkyl-1,2,4-triazole corrosion inhibiting compounds which are not ω-hydroxy substituted, at the same inhibitor concentrations, are presented in the lower portion of Table 1.

TABLE 1

| Corrosion Inhibitor | Corrosion Inhibitor concentration in g/m$^3$ 10 | 5 | 2 |
|---|---|---|---|
| | Anticorrosion Value S | | |
| 3-amino-5-(1-hydroxymethyl)-1,2,4-triazole | 95 | 93 | 80 |
| 3-amino-5-(3-hydroxy-n-propyl)-1,2,4-triazole | 84 | 76 | 70 |
| 3-amino-5-(5-hydroxy-n-pentyl)-1,2,4-triazole | 93 | 79 | 65 |
| 3-amino-5-(8-hydroxy-n-octyl)- | 97 | 94 | 90 |

TABLE 1-continued

| Corrosion Inhibitor | Corrosion Inhibitor concentration in g/m³ 10 | 5 | 2 |
|---|---|---|---|
| | Anticorrosion Value S | | |
| 1,2,4-triazole | | | |
| 3-amino-5-(11-hydroxy-n-undecyl)-1,2,4-triazole | 98 | 95 | 91 |
| Comparison: | | | |
| 3-amino-5-heptyl-1,2,4-triazole | 94 | 87 | 79 |
| 3-amino-5-undecyl-1,2,4-triazole | 92 | 86 | 77 |

EXAMPLE 2

The test procedures outlined in Example 1 were performed on metal strips containing 99.5% zinc and the results of the mass reduction tests are presented below in Table 2. For comparison purposes, the S values of two 3-amino-5-alkyl-1,2,4-triazole corrosion inhibiting compounds which are not ω-hydroxy substituted, at the same inhibitor concentrations, are presented in the lower portion of Table 2.

TABLE 2

| Corrosion Inhibitor | Corrosion Inhibitor concentration in g/m³ 20 | 10 | 5 |
|---|---|---|---|
| | Anticorrosion Value S | | |
| 3-amino-5-(1-hydroxymethyl)-1,2,4-triazole | 91 | 86 | 81 |
| 3-amino-5-(3-hydroxy-n-propyl)-1,2,4-triazole | 82 | 77 | 69 |
| 3-amino-5-(5-hydroxy-n-pentyl)-1,2,4-triazole | 91 | 56 | 44 |
| 3-amino-5-(8-hydroxy-n-octyl)-1,2,4-triazole | 95 | 90 | 87 |
| 3-amino-5-(11-hydroxy-n-undecyl)-1,2,4-triazole | 99 | 98 | 91 |
| Comparison: | | | |
| 3-amino-5-heptyl-1,2,4-triazole | 94 | 90 | 81 |
| 3-amino-5-undecyl-1,2,4-triazole | 89 | 87 | 76 |

Although the present invention has been described in terms of a number of specific examples and emodiments thereof, it will be appreciated by those skilled in the art that a wide variety of equivalents may be substituted for the specific parts and steps of operation described herein, all without departing from the spirit and scope of the present invention, as defined in the appended claims.

What is claimed is:

1. In a method of inhibiting corrosion of a nonferrous metal in contact with water at a pH of about 6 to 10, the improvement comprising adding to the water a corrosion inhibiting amount of a compound selected from the group consisting of:

(a) a 3-amino-5-(ω-hydroxy-n-alkyl)-1,2,4-triazole having the formula:

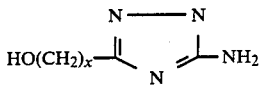

(I)

wherein x is an integer in the range of from 1 to 12;

(b) a salt of the compounds of formula (I) with an inorganic acid;

(c) a salt of the compounds of formula (I) with an organic acid; and (d) mixtures thereof.

2. The method as defined in claim 1, wherein x is an integer in the range of from 7 to 12.

3. The method as defined in claim 1, wherein the inorganic acid salt of the compound of formula (I) is selected from the group consisting of a chloride, a sulfate and a phosphate.

4. The method as defined in claim 1, wherein the organic acid salt of the compound of formula (I) is selected from the group consisting of an acetate, a citrate and a glycolate.

5. The method as defined in claim 1, wherein the corrosion inhibiting amount comprises from 0.05 to 10 g/m³ of said compound.

6. The method as defined in claim 1, wherein the corrosion inhibiting amount comprises from 0.1 to 5 g/m³ of said compound.

7. The method as defined in claim 1 wherein said compound is 3-amino-5-(1-hydroxymethyl)-1,2,4-triazole.

8. The method as defined in claim 1 wherein said compound is 3-amino-5-(3-hydroxy-n-propyl)-1,2,4-triazole.

9. The method as defined in claim 1 wherein said compound is 3-amino-5-(5-hydroxy-n-pentyl)-1,2,4-triazole.

10. The method as defined in claim 1 wherein said compound is 3-amino-5-(8-hydroxy-n-octyl)-1,2,4-triazole.

11. The method as defined in claim 1 wherein said compound is 3-amino-5-(11-hydroxy-n-undecyl)-1,2,4-triazole.

12. The method as defined in claim 3, wherein x is an integer in the range of from 7 to 12.

13. The method as defined in claim 4, wherein x is an integer in the range of from 7 to 12.

14. The method as defined in claim 5, wherein x is an integer in the range of from 7 to 12.

15. The method as defined in claim 6, wherein x is an integer in the range of from 7 to 12.

16. The method as defined in claim 1 wherein: x is an integer in the range of from 7 to 12; the inorganic acid salt of the compound of formula (I) is selected from the group consisting of a chloride, a sulfate, and a phosphate; the organic acid salt of the compound of formula (I) is selected from the group consisting of an acetate, a citrate, and a glycolate; and said compound, a salt thereof, or a mixture thereof, is present in about 0.05 to about 10 grams per cubic meter of said water.

* * * * *

UNITED STATES PATENT AND TRADEMARK OFFICE

CERTIFICATE OF CORRECTION

PATENT NO. : 4,734,257

DATED : Mar. 29, 1988

INVENTOR(S) : Josef Penninger

It is certified that error appears in the above-identified patent and that said Letters Patent is hereby corrected as shown below:

At the cover page, col. 2, under ABSTRACT; at col. 2, lines 18-22; and at col. 6, lines 1-5, delete:

"

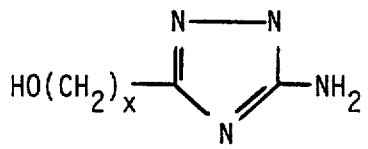

"

and insert:

--

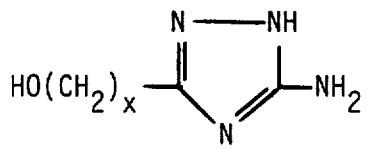

--

At col. 5, line 46, delete "emodiments" and insert --embodiments--.

Signed and Sealed this

Twenty-sixth Day of September, 1989

*Attest:*

*Attesting Officer*

DONALD J. QUIGG

*Commissioner of Patents and Trademarks*